United States Patent [19]

Otto, Jr. et al.

[11] Patent Number: 4,584,862

[45] Date of Patent: Apr. 29, 1986

[54] ROLLING PROCEDURES FOR ELIMINATING ALLIGATOR DEFECT FORMATION

[75] Inventors: William L. Otto, Jr., Allegheny Township, Westmoreland County; Howard A. Kuhn, Richland Township, Allegheny County, both of Pa.

[73] Assignee: Aluminum Company of America, Pittsburgh, Pa.

[21] Appl. No.: 632,406

[22] Filed: Jul. 19, 1984

Related U.S. Application Data

[63] Continuation-in-part of Ser. No. 532,848, Sep. 16, 1983, abandoned.

[51] Int. Cl.[4] ..... B21B 1/06

[52] U.S. Cl. ..... 72/226; 72/229; 72/366

[58] Field of Search ..... 72/226, 234, 365, 366, 72/229, 21, 35, 199, 240

[56] References Cited

U.S. PATENT DOCUMENTS 4,480,458 11/1984 Bogovich ..... 72/229

FOREIGN PATENT DOCUMENTS 55-77901 6/1980 Japan ..... 72/365
56-19908 2/1981 Japan ..... 72/366
914119 3/1982 U.S.S.R. ..... 72/365

*Primary Examiner*—Francis S. Husar
*Assistant Examiner*—Steven B. Katz
*Attorney, Agent, or Firm*—Elroy Strickland

[57] ABSTRACT

A method for reducing the thickness of a slab of metal under conditions which tend to cause alligator defects to occur. The method comprises the steps of directing a relatively thick slab of metal several times through a rolling mill or mills to incrementally reduce the thickness of the slab until the thickness approaches a value that tends to produce a longitudinal and lateral fracture in one or both ends of the slab. The thickness of the slab is further reduced by passing the same several times again through a rolling mill or mills, with each of the passes of the slab taking a decreasing amount of reduction in thickness until a predetermined thickness value is reached. The next step involves passing the slab again through a rolling mill to further reduce the thickness thereof, the amount of reduction in this step and pass being substantially greater than that of the last pass immediately preceding this step.

2 Claims, 4 Drawing Figures

ROLLING PROCEDURES FOR ELIMINATING ALLIGATOR DEFECT FORMATION

CROSS-REFERENCE TO RELATED APPLICATION

This application is a continuation-in-part of U.S. application Ser. No. 532,848, filed Sept. 16, 1983 now abandoned.

BACKGROUND OF THE INVENTION

The present invention relates generally to the thickness reduction of metal slabs, and particularly to a method of reducing the thickness of slabs in a manner that avoids alligatoring in the ends of the slabs.

Large ingot that is slated for reduction in thickness for purposes of being rolled in a rolling mill to make sheet or plate products typically requires "breakdown" in a rolling mill. Breakdown rolling involves numerous passes of the ingot through the mill, usually a reversing mill, at temperatures in the range of about 250° C. to about 550° C. for aluminum ingot. This provides a slab of metal material. After appreciable amounts of reduction involving such passes of the slab through the mill, fractures tend to occur in the ends of the slab. These fractures extend in a central plane that is parallel to the rolled surfaces of the slab.

Such fracturing, or alligatoring, as it is known in the rolling art, may be caused by an internal stress state in the slab which is the result of nonuniform deformations that take place in the initial passes. As the breakdown rolling process proceeds, internal stresses may be sufficient to open up a slab that contains central defects or is made of a material of limited ductility, as in the case of a slab of the aluminum 8% magnesium alloy.

Whatever the cause of alligatoring, the subject matter of the present invention is directed to substantially limiting the occurrence of such alligatoring, if not preventing the same altogether. It can be appreciated that with the occurrence of alligatoring a substantial amount of scrap is generated, as the split portions of the slab must be removed from the main body thereof before the slab is further reduced. The removal of the split ends also increases costs by increasing the breakdown rolling time for each ingot, i.e., there is lower productivity. Control or elimination of alligator formations therefore reduces scrap loss and rolling time, and thus improves the efficiency of the breakdown rolling process.

BRIEF SUMMARY OF THE INVENTION

The present invention is directed to the discovery that alligatoring can be avoided in the breakdown rolling process by taking decreasing amounts of reduction until the thickness of a slab reaches a predetermined thickness value, which thickness value is near a value at which alligatoring tends to occur, and then sharply increasing the reduction to a point at which alligatoring cannot occur.

THE DRAWINGS

The invention, along with its advantages and objectives, is best understood from consideration of the following detailed description and the accompanying drawings:

FIG. 1 of which shows the end of a slab that is split apart;

PREFERRED EMBODIMENT

Figure 1:
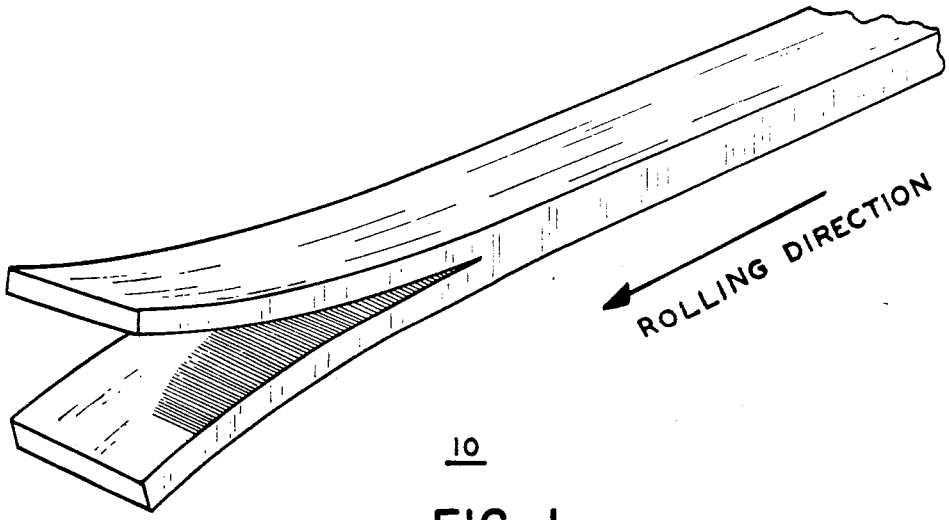

Referring now to the drawings, and particularly FIG. 1 thereof, the end of a heated slab of metal 10 is depicted as being split apart. This shows the problem encountered in reducing the thickness of ingot and slabs of metal.

Figure 2:
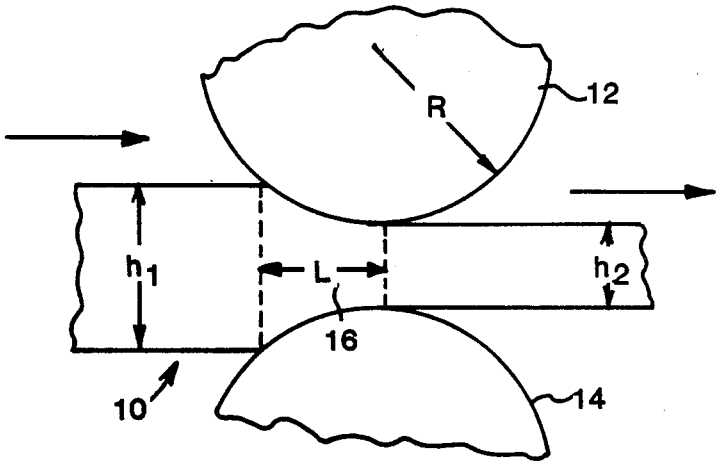
FIG. 2 shows in partial elevation the work rolls and work zone of breakdown rolling mill.

FIG. 2 of the drawings shows in partial elevation two work rolls 12 and 14 of a rolling mill (not otherwise shown) and a slab of metal 10 in the process of being directed through the work zone 16 of the work rolls. The length L of the work zone extends from the location at which slab 10 engages the rolls as it enters the work zone (from the left in FIG. 2) to the location at which the slab leaves the work zone, at the right of the rolls in FIG. 2. The average thickness of the slab in the work zone can be defined by the formula:

$$h \approx (h_1 + h_2)/2 \tag{1}$$

where $h_1$ is the thickness of the slab entering the work zone, and $h_2$ is the thickness of the slab leaving the work zone.

Figure 3:
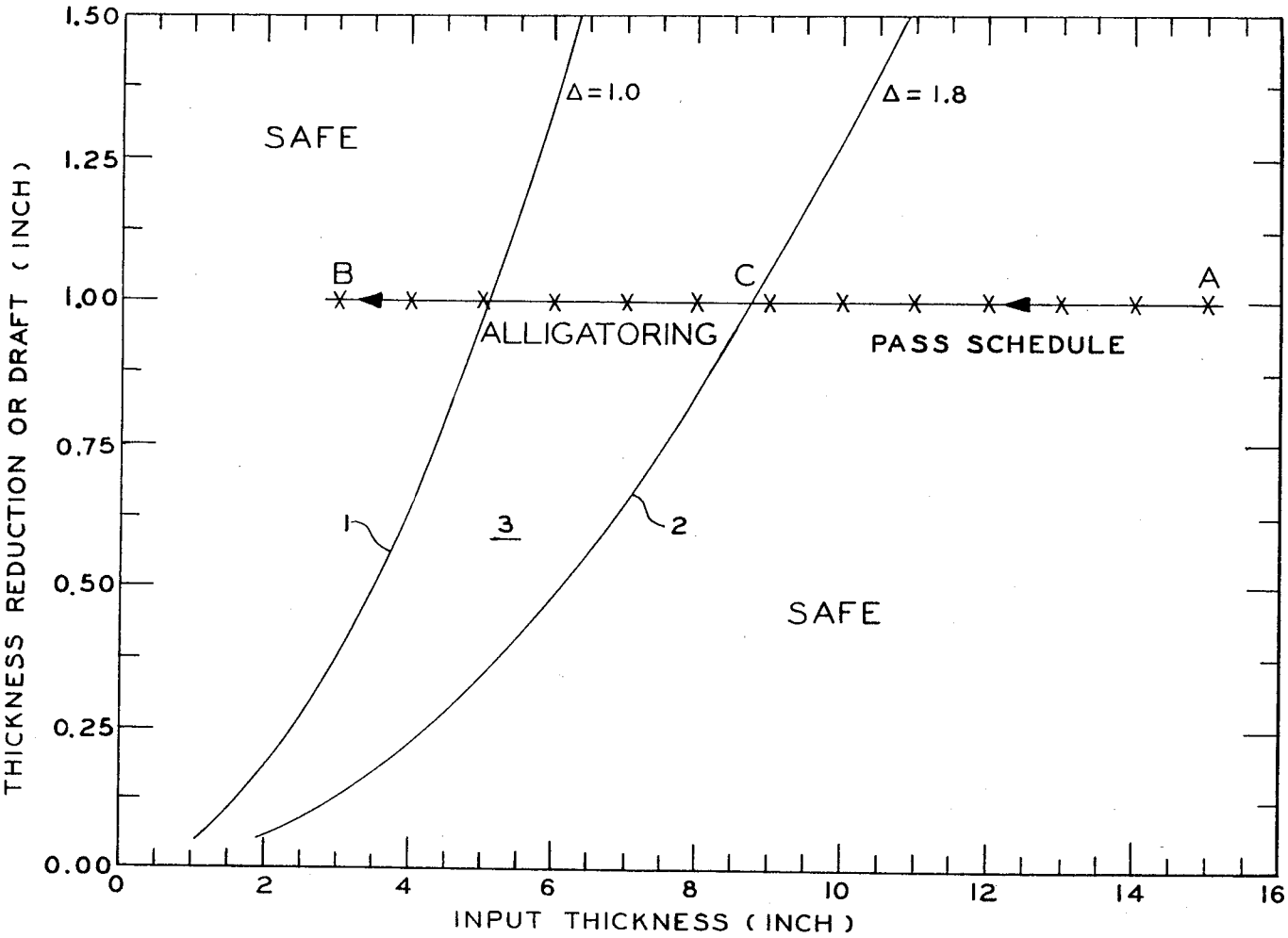
FIG. 3 shows plots of experimental data that establishes the criteria describing the rolling conditions in reference to alligator fractures.

FIG. 3 of the drawings shows two solid line curves 1 and 2 of a graph that represent the results of experimental data developed from rolling slabs in a breakdown mill and in a manner that describes the conditions that cause the alligatoring of FIG. 1. The abscissa of the graph in FIG. 3 indicates the input thickness (in inches) of a slab to be reduced in thickness in a rolling (breakdown) mill, while the ordinate of the graph lists drafts or reductions in thickness (in inches) taken by the mill when a slab is directed therethrough. More particularly, the two curves define combinations of slab entry thickness and thickness reduction, and a zone 3 of input thickness versus draft, in which alligator defects tend to occur.

The two curves of FIG. 2 are developed from the equation:

$$h_1 = \Delta \sqrt{R(h_1 - h_2)} + (h_1 - h_2)/2 \tag{2}$$

where $\Delta$ is the ratio of the average thickness of slab material in a work zone 16 (FIG. 2) of a rolling mill to the length of the work zone, $h_1$ and $h_2$ are respectively the entry and exit thicknesses of the slab material, as indicated in FIG. 2, $h_1 - h_2$ is the thickness reduction or draft effected in the work zone, and R is the radius of the work rolls of the mill.

$\Delta$, i.e., the delta value, being a ratio is dimensionless. The above formula is derived from the formula:

$$\Delta \simeq \sqrt{h_o/4Rr}\,[2 - r] \tag{3}$$

disclosed on page 88 of the textbook "Deformation Processing" by Walter A. Backofen, published in 1972 by Addison-Wesley Publishing Company. This latter formula defines the basic feature of the channel between the work rolls of a mill in terms of the mean thickness to length ratio of the plastic work zone or area that fills the channel. The term "$h_o$" is that of "$h_1$" (entry thickness) in equation (2), and "r" is the reduction $$(h_1-h_2)/h_1 \quad (4)$$

Figure 4:
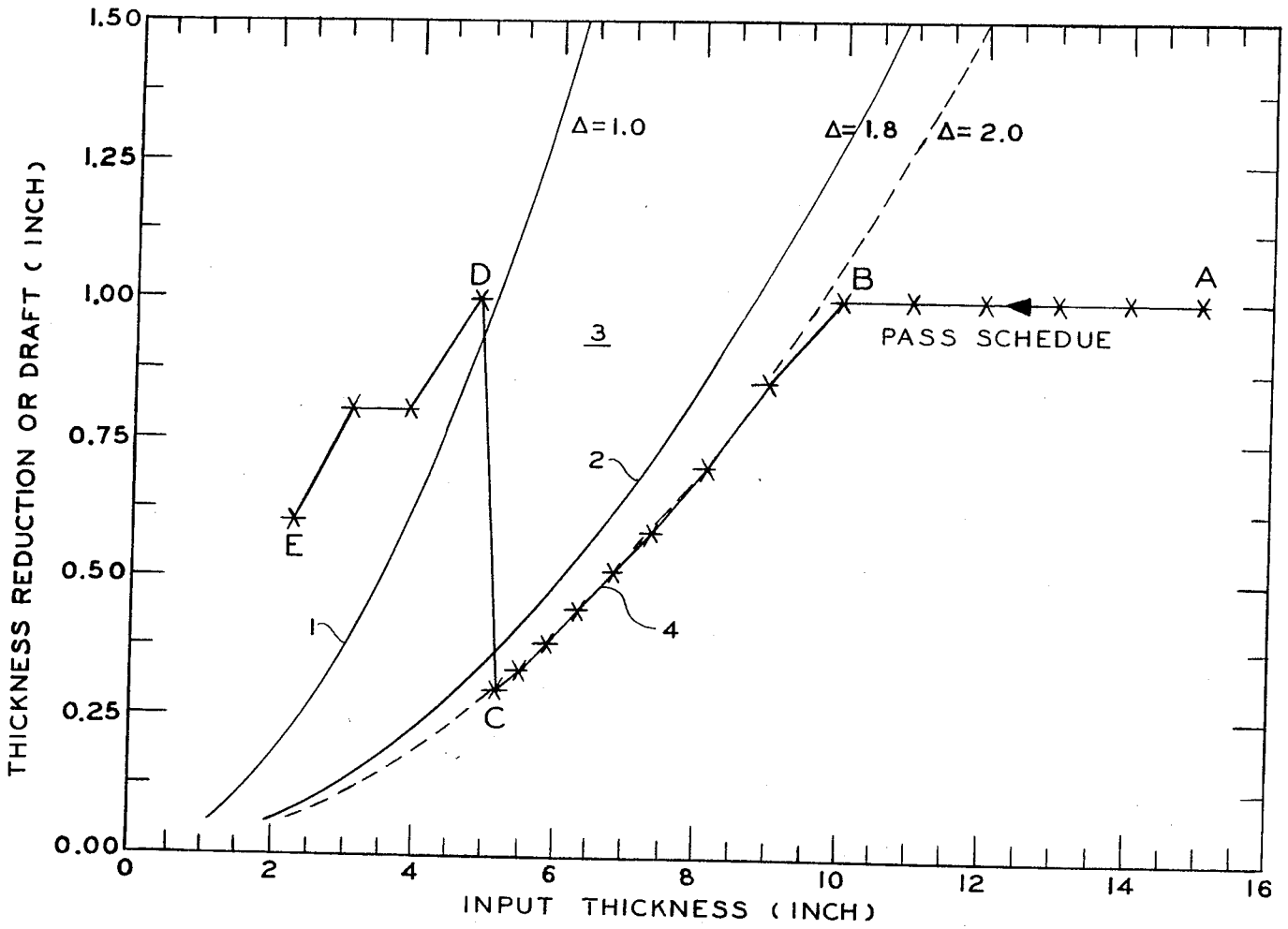
FIG. 4 shows the plots of FIG. 3 and a rolling method that avoids the formation of alligator fractures.

By knowing the ratio (delta value) of the average thickness of the slab material in work zone 16 to the length of the work zone, and the radii of work rolls 12 and 14, entry thickness ($h_1$) can be chosen, in accordance with the invention, to avoid alligatoring of the slab. The delta curves 1 and 2 in FIGS. 3 and 4 were developed from equation (2) using 21-inch radius (R) work rolls. This provided finite lengths for work area 16 for respective finite entry and exit thicknesses ($h_1$ and $h_2$) of slab 10. For example, 21-inch work rolls provide a work zone length of 4.60 inches when the entry thickness of a slab is 8.75 inches, and a one-inch reduction in thickness is taken. The Δ value here, i.e., the ratio of average thickness in 16 to the length of 16 is 1.80. This relationship, of course, changes with changes in entry thickness and thickness reduction, as well as work roll diameter, since these parameters directly affect the finite length of the work zone and the average thickness of the metal in the work zone. Since Δ describes this changing relationship, it can be represented by curves by plotting finite thicknesses against finite reductions in thickness, as shown in FIGS. 3 and 4.

As indicated earlier, it has been found that with certain deltas alligatoring of a slab occurs, while with other deltas alligatoring does not occur. More particularly, any ratio of average slab thickness in the work zone to the length of the work zone above 1.8 does not produce alligatoring; the same is true for any such ratio of 1.0, or less.

Hence, curve 1 in FIG. 3 describes a Δ boundary on the left and curve 2 defines a Δ boundary on the right, between which is a zone 3 in which alligatoring fractures tend to occur. On the left-hand side of curve 1, and on the right-hand side of curve 2, the reductions taken on an ingot are in a "safe" zone with regard to the formation of alligator fractures. For example, if one-inch reductions (line BCA) are taken on an ingot that is greater in thickness than approximately 8.75 inches, as represented on the A (right-hand) side of curve 2, the ends of the ingot will not experience the alligator phenomenon. The ends of such an ingot will, however, form such fractures when one-inch reductions are taken on ingots of 8.75 inches in thickness or less, down to about 5.10 inches in thickness; on the graph of FIG. 3 the alligatoring tendency begins adjacent point C and continues for about three one-inch passes (X's) in zone 3. When the one-inch reductions move to a point beyond curve 1 (on the left) and toward point B on the graph, alligatoring ceases or tends not to occur.

The above analysis is applicable to reduction amounts other than one inch, as any amount of reduction within zone 3 (of Δ curves 1 and 2) will cause alligatoring.

Because of the phenomenon described above, the invention proposes the pass schedule of FIG. 4 of the drawings. With the distance between each X again denoting a single pass through a rolling mill, the initial passes, beginning at an ingot thickness of about 15 inches (point A) can be constant one-inch reductions until the thickness of the ingot is reduced to about 10 inches (point B in FIG. 4). The reduction taken need not be constant, of course, nor need it be one inch, as any reduction, and entry thickness to work zone length, which is the delta parameter of equation (1), in the area to the right of curve 2 (Δ=1.8) will not generally cause alligatoring.

After point B in FIG. 4, the size of the reductions taken by the passes (X) decrease incrementally along a dash line 4 that is close to but to the right of curve 2. At point C, which is at a reduction of about 0.30 inch for a slab thickness of 5.20 inches, the incremental decrease in the amount of each reduction taken ceases.

A next, further reduction is now taken in the slab (point D); however, this reduction is a large one, i.e., on the order of one inch again, and is located to the left of curve 1 (Δ=1.0). This places the reduction (again) in a "safe" zone (on the left of curve 1), with no reductions or passes being taken in zone 3.

Further reductions in thickness are shown in FIG. 4 (to point E), which reductions involve finishing operations that provide a final desired slab thickness. None of these latter reductions are, of course, in problem area 3.

By virtue of the above analysis and procedure, ingot and slabs of metal can be reduced in thickness in a rolling mill without alligator fractures occurring in the ends of the slabs.

While the invention has been described in terms of preferred embodiments, the claims appended hereto are intended to encompass all embodiments which fall within the spirit of the invention.

What is claimed is:

1. A method of reducing the thickness of a slab of metal in which alligatoring defects tend to occur, the method comprising the steps of:

determining an amount of reduction in thickness and a thickness value that tend to produce a longitudinal fracture in one or both ends of the slab, directing a relatively thick slab of metal through one or more rolling mills to incrementally reduce the thickness of the slab until its thickness approaches said thickness value that tends to produce a longitudinal fracture in one or both ends of the slab, continuing to reduce the thickness of the slab by passing the same through the mill or mills, with each pass of the slab taking a decreasing amount of reduction in thickness, discontinuing the step of taking a decreasing amount of reduction in thickness, while the thickness of the slab is still greater than said thickness value that tends to produce a longitudinal fracture, and passing the slab again through the mill or mills to reduce the thickness thereof below said thickness value that tends to produce a longitudinal fracture, the amount of reduction in this pass being substantially greater than the last pass of the slab through the mill in said step of taking a decreasing amount of reduction in thickness preceding this step.

2. The method of claim 1 in which the reductions in thickness taken in the second step are constant amounts.

* * * * *